United States Patent [19]

McLaren et al.

[11] 3,970,215

[45] July 20, 1976

[54] DISPENSING PACKAGE FOR MOISTENED TISSUES

[75] Inventors: Edwin C. McLaren, Apple Valley; Howard R. Schneider, Minneapolis, both of Minn.

[73] Assignee: Hoerner Waldorf Corporation, St. Paul, Minn.

[22] Filed: Jan. 24, 1975

[21] Appl. No.: 543,962

[52] U.S. Cl. ..... 221/45; 206/233; 206/494; 229/14 B

[51] Int. Cl.[2] ..... A47K 10/20

[58] Field of Search ..... 221/46, 45, 47, 48, 221/50, 51, 63; 222/107; 206/205, 233, 494; 229/51 D, 14 R, 14 B, 14 BA, 14 BW, 14 BL

[56] References Cited

UNITED STATES PATENTS

| | | | |
|---|---|---|---|
| 2,574,345 | 11/1951 | Montgomery | 206/233 X |
| 2,617,579 | 11/1952 | Buttery | 229/14 BA X |
| 3,171,571 | 3/1965 | Daniels | 229/14 B X |
| 3,239,097 | 3/1966 | Bates et al. | 221/48 |
| 3,784,055 | 1/1974 | Anderson | 221/63 X |

*Primary Examiner*—Robert B. Reeves
*Assistant Examiner*—Joseph J. Rolla
*Attorney, Agent, or Firm*—Jerry F. Best

[57] ABSTRACT

A novel package for containing and dispensing moistened tissues which are arranged in a folded stacked array, including a film wrapper surrounding the stack of tissues and sealed on the ends with a longitudinal overlap of the edges on the top of the stack which allows access for removal of the tissues. This overlapping edge is sealed initially with an adhesive strip which is removable and the entire stack and wrapper are placed within a paperboard carton with a removable section in the top panel which allows access to the strip and overlapping edge to facilitate removal of the tissues. The package further includes means for retaining the film wrapper within the carton as the tissues are removed so that it does not pull out through the opening in the carton.

1 Claim, 7 Drawing Figures

DISPENSING PACKAGE FOR MOISTENED TISSUES

BACKGROUND OF THE INVENTION

1. Field of the Invention

This disclosure relates generally to packages particularly adapted for containing and dispensing moistened tissues or the like, and more particularly to those wherein the moistened tissues are retained within a barrier film wrapper and where that wrapper is placed within a carton which provides strength rigidity to the package.

2. Description of the Prior Art

The use of moistened tissues for any number of a variety of applications in industry and in the household is becoming more and more widespread. Accordingly there are a number of packages for containing and dispensing moistened tissues, and it is necessary that these packages have barrier qualtities to whatever liquid is used to moisten the tissues. Many of these packages have employed the use of a plastic tray or extruded cylinder arrangement. Another type of package is that employing a paperboard carton wherein the paperboard is provided with barrier qualtities either through the addition of a laminate foil or film or through some coating which is moisture resistant. While many of these designs are satisfactory from a performance standpoint, there is a need for a package which provides the appropriate moisture barrier, is light in weight, is easy to assembly and manufacture, and yet is light in weight and low in cost as compared to those designs and styles presently available.

SUMMARY OF THE INVENTION

Accordingly, it has been found that a satisfactory package may be obtained by enclosing a stacked array of moistened tissues in a film wrapper which is sealed on the ends and has overlapping edges extending along the top surface which are sealed by an adhesive strip. Once this strip is removed the tissues may be pulled out through the overlapping edges and the overlapping edges will remain in position to retard the loss of moisture from the package. This wrapped stack is then placed within a conventional rectangular paperboard carton having a removable access panel in its top surface so that the tissues may be removed through the carton, and further, means are provided for retaining the film wrapper in position inside the carton so that as the tissues are removed the sheet of film will not be pullled out through the opening in the carton.

DETAILED DESCRIPTION OF THE PREFERRED EMBODIMENT

Figure 1:
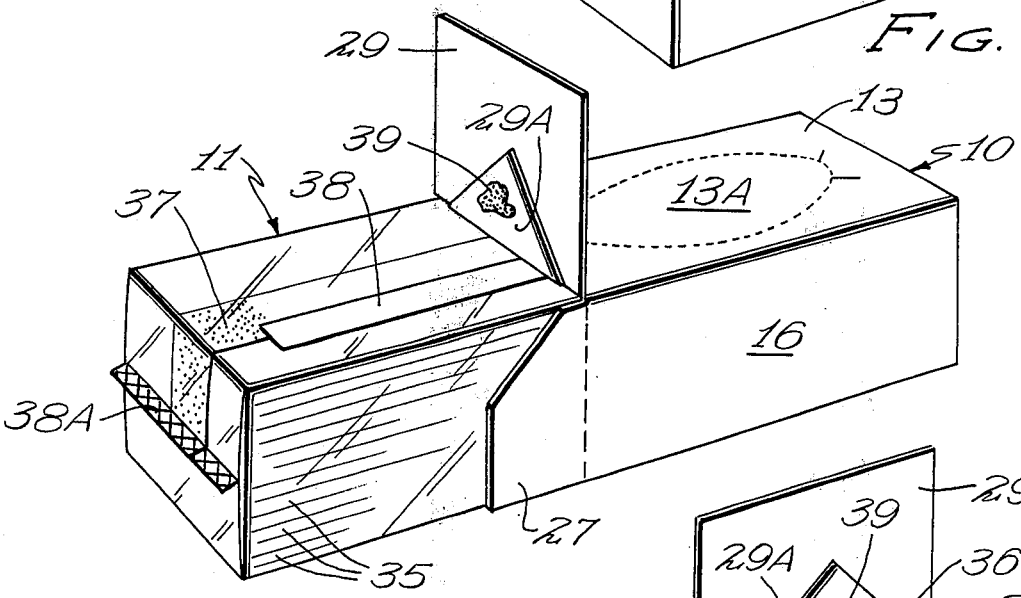
FIG. 1 is a perspective view of a package embodying the present invention shown partially disassembled to illustrate the relationship between the carton and the stack of tissues.

This invention shows a novel and improved method of containing moistened tissues for consumer use, and as can be seen in FIG. 1 the package has three major elements, including an outer carton 10 and a stacked array of tissues enclosed in a film wrapper, shown together generally as 11. For purposes of this disclosure, it should be understood that the term "moisture" is meant to include not only water but any of the common oils or other solutions including waxes, which may be found desirable for impregnation into a tissue or cloth for use in the home, in hospitals or in other businesses. Accordingly, the film which will be described structurally in this disclosure is meant to include any appropriate barrier sheet material for the particular liquid or moisture substance which is to be used, and is not meant to exclude such sheet materials as foil or impregnated paper.

Figure 2:
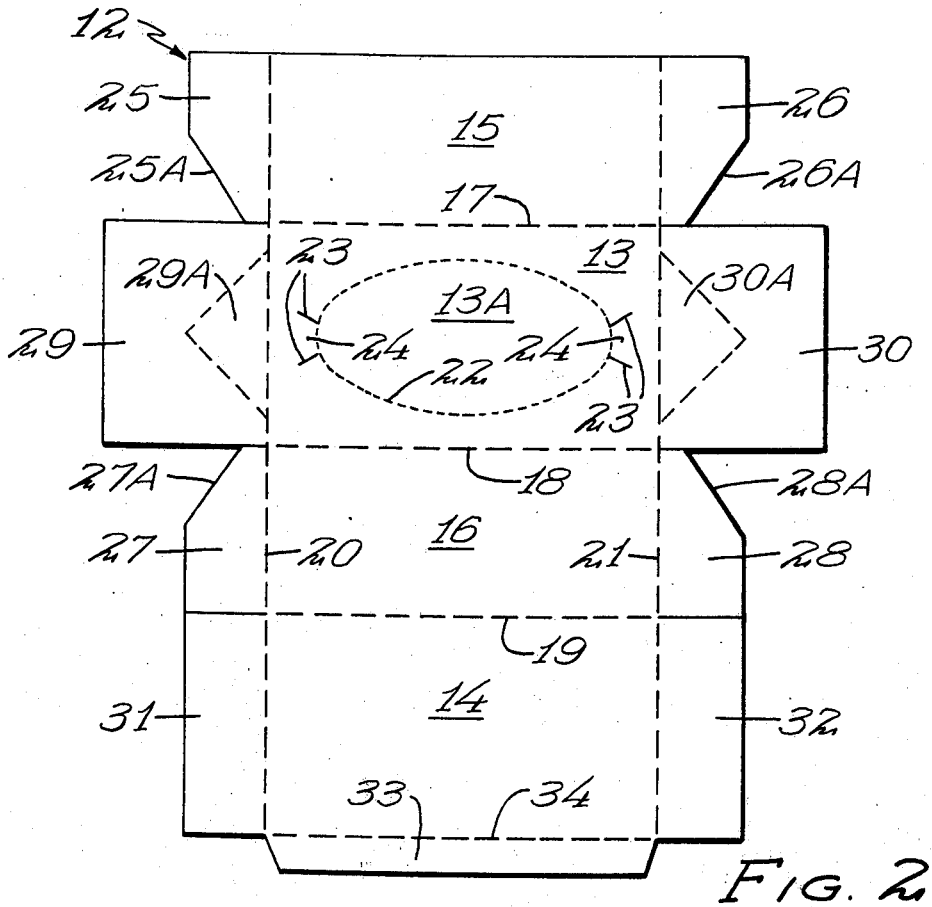
FIG. 2 is a blank shown in plan view adapted to be folded into a carton such as that described in the present invention.

As can be seen in FIG. 2 an outer carton is provided and includes a blank shown generally as 12 which is made from foldable paperboard or similar sheet-like material and has a top surface 13, a bottom surface 14, opposed lateral side panels 15 and 16, all of which are hingedly connected along parallel horizontal fold lines 17, 18 and 19 and whose length is defined by two parallel vertical fold lines 20 and 21. The blank 12 is dapted to be folded into a rectangular tubular configuration and as such comprises a typical end-load carton. The top surface 13 has formed therein a panel 13A which is defined by an endless line of separation 22 and which is adapted to be removed by breaking that frangible line of separation 22 in a conventional manner. In addition, there are small outwardly extending line cuts 23 at the ends of the panel 13A which provide a downwardly or upwardly flexible tab-like area 24 which may be necessary to provide access for the initial removal of the adhesive strip to be described later.

Figure 4:
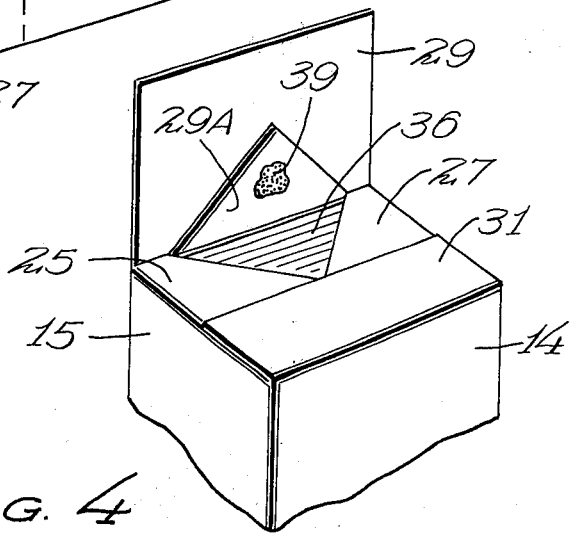
FIG. 4 illustrates the operation of the end closure of the carton and one method of securing the film to the carton.

The end closures of the carton are formed by inwardly foldable closure flaps, and include minor flaps connected to the side panels of the carton, shown as 25 and 26 at the opposite ends of the side panel 15, connected along the vertical hinge lines 20 and 21, and the flaps 27 and 28 at opposite lateral ends of the side panel 16 also connected along the hinge lines 20 and 21. These end flaps, or minor flaps, each have a cutaway portion shown as 25A, 26A, 27A and 28A which as seen in FIG. 4 allow exposure of a portion of the major flaps 29 and 30 which are hingedly attached to the opposite ends of the top surface 13 along hinge lines 20 and 21. These major flaps which are foldable downwardly over the ends of the carton, have an inwardly embossed section 29A and 30A respectively whose function will be described later. It can be seen in the Figures that the major flaps 29 and 30 are formed to completely cover the ends of the carton, and accordingly the end flaps which are attached to the bottom surface 14, which are shown as 31 and 32 are formed in height an amount smaller than the major flap, and are equal to the end flaps of the side panels so that in final folded position the embossed areas 29A and 30A are exposed to the stacked array of tissues. The carton blank 12 may be assembled in any conventional manner, and in the particular embodiment shown a glue flap 33 is provided along one lateral edge and connected along a hinge line 34 to the bottom surface 14 and serves as a manufacturer's glue flap.

Figure 5:
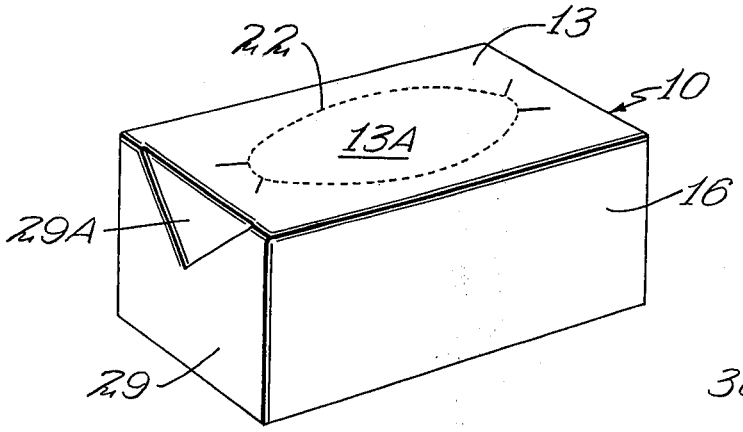
FIG. 5 is a perspective view of a package embodying the present invention which is completely closed.
Figure 6:
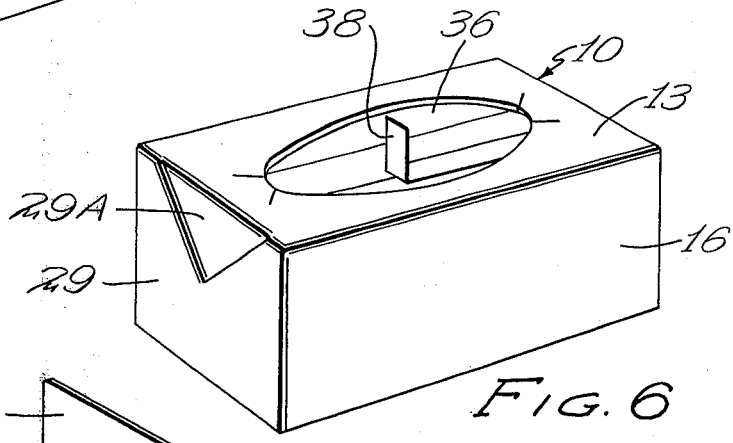
FIG. 6 is a perspective view of a package such as shown in FIG. 5 but with the removable panel in the top surface taken away and with the adhesive strip partially removed to illustrate the opening of the package.
Figure 3:
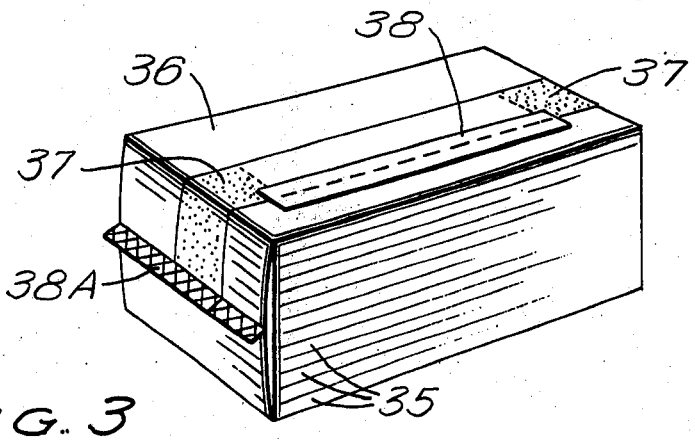
FIG. 3 shows a stacked array of tissues enclosed within a sealed film wrapper such as described in the present invention.
Figure 7:
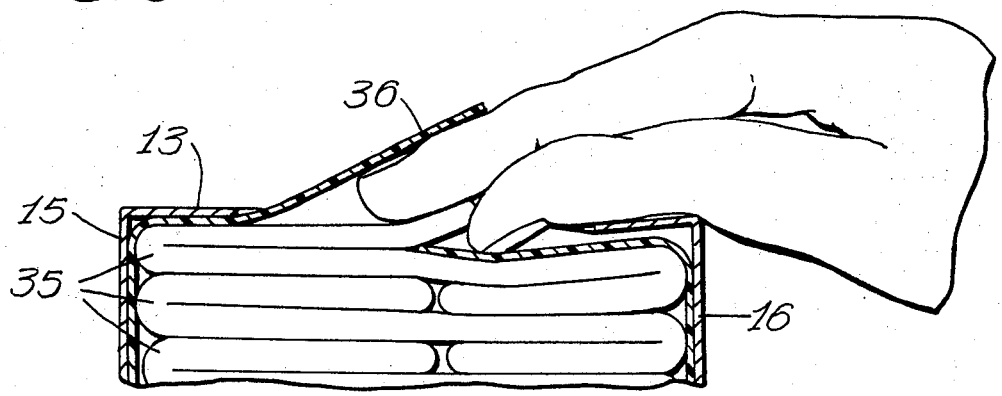
FIG. 7 is a side elevational section view designed to illustrate the removal of the tissues from the package through the overlapping film wrapper.

In FIG. 3 the stacked array of tissues, which are collectively shown as 35 are enclosed in a film wrapper similar to that shown in U.S. Pat. No. 2,573,309 to E. A. Chipkevich, issued on Oct. 30, 1951. As can be seen in FIG. 3 and FIG. 7, the film 36 is utilized as a single sheet and wraps around the stacked array of tissues and is arranged with an overlapping area designated generally as 37 at the top surface of the stacked array and as can be seen in FIG. 7 provides access for removal of the tissues. In addition, this overlapping area provides some measure of protection against moisture loss after the package is opened, and the sealing of the package is accomplished by a strip of adhesive film or tape shown as 38 which is placed over the joint between the overlapping sections at 37 and as shown in FIG. 6 is removable through the opening left when the panel 13A is taken away from the carton 10. The film 36 is sealed on the ends at 36A by any conventional method and as can be seen in FIG. 1, the stacked array wrapped in film is then inserted into the carton by the conventional end-load process.

FIG. 4 clearly illustrates how the minor flaps are first folded inwardly followed by the flap from the bottom surface and lastly by the major flap which covers all of the end of the carton. FIG. 4 illustrates only one end of the carton, that end shown in the left side of the package in all of the other various drawings. The extent over which the adhesive tape 38 extends is variable, and if it is desired that the tape not extend around the corner and down to the seal 36A on the side of the stacked array of tissues, then it is necessary to seal that portion of the overlapping area 37 slightly beyond that point which will be covered by the tape 38. It is possible, of course, to locate the seal 36A at the top edge of the stacked array so that no additional sealing is necessary and so that the tape can completely take care of the barrier for the moisture in the package. It should be understood that this type of package allows a simple and inexpensive paperboard carton to be used which does not have barrier qualities and in conjunction has a simple and inexpensive sleeve or bag-type film covering over the stacked array of tissues.

In FIGS. 1 and 4 it can be seen that there is a mass of adhesive shown as 39 which is placed on the embossed area of the major flap and which comes in contact when folded downwardly with the end of the film wrapper so that when the tissues are removed, the film wrapper does not pull out through the opening left from removing the panel 13A in the top surface 13. It should be understood that the preferred embodiment shows the adhesive at the top of the package so that the bag does not collapse downwardly after several tissues have been removed. However, there are other techniques for applying this adhesive such as placing a mass at one end of the lateral side of the stacked array so that as the array is loaded into the carton the mass of adhesive is smeared along the side of the carton thereby avoiding the use of embossed end flaps. It may also be found that if a sufficient amount of adhesive is used, there will be no need for the embossed areas 29A and 30A on the major flaps.

In accordance with the Patent Statutes, we have described the principles of construction and operation of our improvement in DISPENSING PACKAGE FOR MOISTENED TISSUES; and while we have endeavored to set forth the best embodiment thereof, we desire to have it understood that obvious changes may be made within the scope of the following claims without departing from the spirit of our invention.

We claim:

1. A dispensing package for moistened tissues or the like, said tissues arranged in a folded stacked array, comprising:

a sheet of flexible moisture proof film surrounding said stacked array of tissues, said sheet having overlapping longitudinal edges arranged on the top of said stacked array to form an opening through which said tissues may be removed, said sheet also having sealed ends to complete the enclosure of said stacked array;

means sealing said overlapping edges and adapted to allow said edges to be opened for removal of the tissues;

an outer enclosure carton made from foldable paperboard or similar sheet-like material, said carton being substantially rectangular in cross section and having a top surface, a bottom surface, opposed lateral side panels and closed with opposed rectangular end panels;

said top surface having formed therein a panel defined by frangible edges adapted to be removed to provide access to said sealing means and said stacked array of tissues in said package;

said end panels comprising minor flaps hingedly connected to said side panels of said carton, said minor flaps inwardly foldable to lie flat against the sealed end of said film;

a major flap hingedly connected to said top surface of said outer carton and foldable downwardly to lie in overlapping relation with said minor flaps;

said minor flaps having cut-away portions at the upper end thereof, said cut-away portions thereby exposing a section of said major flap to the end of said film surrounding said stacked array;

said exposed section on said major flap overlapping said cut-away portions of said minor flaps being inwardly embossed, said embossed portion of said major flap thereby lying flush against the end of said film and stacked array in final closed position; and a mass of adhesive positioned between and contacting both said embossed portion and said film wrapper to retain said film wrapper within said carton as the tissues are removed therefrom.

* * * * *